US005161343A

United States Patent [19]

Edwards et al.

[11] Patent Number: 5,161,343

[45] Date of Patent: Nov. 10, 1992

[54] DECORATIVE FILE CABINET DOOR

[75] Inventors: John Edwards, Nobleton; Douglas Boileau, Bradford, both of Canada

[73] Assignee: Hollanding Inc., Newmarket, Canada

[21] Appl. No.: 574,042

[22] Filed: Aug. 29, 1990

[51] Int. Cl.[5] ..... A47B 88/00

[52] U.S. Cl. ..... 52/455; 52/311; 52/314; 40/580; 40/582; 312/111; 312/108

[58] Field of Search ..... 40/580, 582; 52/314, 52/313, 455, 311; 312/108, 109, 114, 111

[56] References Cited

U.S. PATENT DOCUMENTS 2,411,187 11/1946 Boogher ..... 40/582
2,752,708 7/1956 Sundquist ..... 40/580
3,064,380 11/1962 Baut et al. ..... 52/311
4,239,306 12/1980 Klaus ..... 312/108

*Primary Examiner*—David A. Scherbel
*Assistant Examiner*—Wynn E. Wood
*Attorney, Agent, or Firm*—Riches, McKenzie & Herbert

[57] ABSTRACT

A file cabinet door is disclosed whose front carries a contrasting design or pattern. Decorative openings are provided through a front panel in the door in the form of a pattern. A decorative interior panel of contrasting appearance to the front panel is provided rearward of the front panel. A person on viewing the front panel sees a contrasting design by reason of the openings rendering the interior panel visible therethrough.

5 Claims, 3 Drawing Sheets

DECORATIVE FILE CABINET DOOR

SCOPE OF THE INVENTION

This invention relates generally to doors for filing cabinets and, more particularly, to a file cabinet door having a decorative appearance by reason of openings cut through a front panel of the door in the form of a pattern and rendering visible therethrough a contrasting decorative panel.

Presently, decorative patterns including designs and logos may be applied to file cabinet doors by painting them on the door or by mechanically attaching them to the door. Painting a pattern on a door has the disadvantage of requiring at least one additional step in manufacture and requiring customized templates and the like, making it difficult to customize production.

The mechanical attachment of logos and designs to a door has a disadvantage that the attachment must be made in advance and require customized manufacture. This also makes it difficult to quickly customize production.

SUMMARY OF THE INVENTION

Accordingly, it is an object of the present invention to at least partially overcome these disadvantages by providing a file cabinet with decorative openings cut from its front surface and a contrasting interior panel behind the openings visible therethrough.

To this end, in one of its aspects, the invention provides for a door for a file cabinet comprising a front panel and a decorative panel behind the front panel with decorative openings in the form of a pleasing design provided through the front panel so that portions of the decorative panel are visible therethrough, particularly with these portions having a contrasting visual appearance to that of the front panel.

Another object is to provide a method for manufacturing file cabinet doors having decorative openings cut therethrough which facilitates prompt selection and alteration of the pattern formed by the decorative openings.

Accordingly, in another aspect, this invention provides for a method for manufacturing a door for a filing cabinet having a front panel and decorative openings through the front panel so that portions of the decorative panel are visible therethrough. The method comprises fabricating the front panel from a sheet of metal including the steps of retaining the sheet in a gig of an automated punch press, removing both first functional openings and second decorative openings by the automated punch press while the sheet is retained by the gig. The first functional openings are openings required for coupling the sheet to the remainder of the file cabinet door. The second decorative openings are in the form of a desired pattern.

BRIEF DESCRIPTION OF THE DRAWINGS

Further objects and advantages of the invention will appear from the following description taken together with the accompanying drawings in which.

DETAILED DESCRIPTION OF THE DRAWINGS

Figure 1:
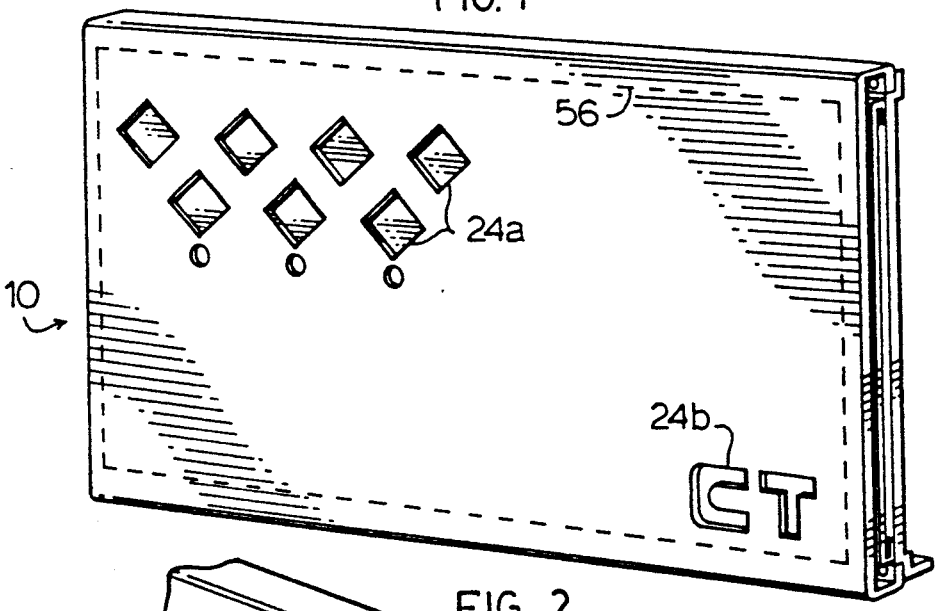
FIG. 1 is a perspective view of a file cabinet door in accordance with the present invention.
Figure 2:
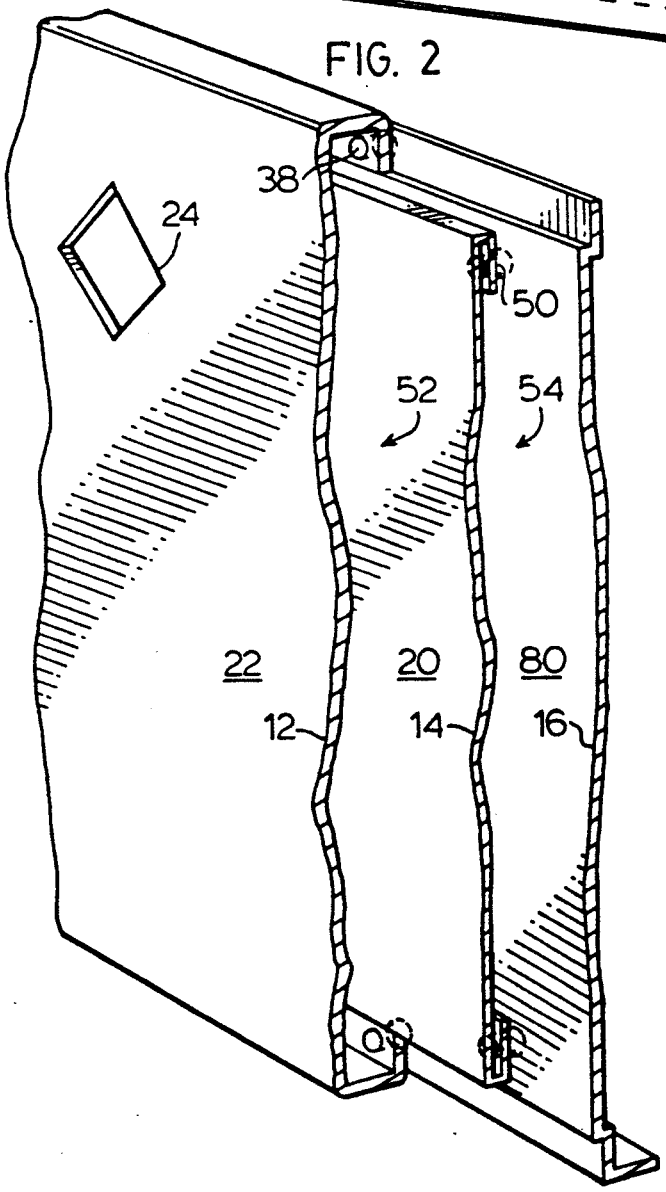
FIG. 2 is an enlarged partially cut away perspective view of the door of FIG. 1.

Reference is now made to FIGS. 1 and 2 which show a file cabinet door 10 of sheet metal construction having a front panel 12 extending over substantially the entirety of the front face of the door, a decorative intermediate panel 14 and a rear panel 16 extending over substantially the entirety of the front panel 12.

As will be described later, the panels are secured together with the intermediate panel 14 in between front panel 12 and rear panel 16. The outer surface 20 of intermediate panel 14 is preferably of a contrasting colour and/or texture to the outer surface 22 of front panel 12. The front panel 12 has decorative openings 24 cut out therefrom so that the intermediate panel 14 is visible through openings 24. Thus, the cabinet door 10 provides a pleasing visual appearance by reason that when viewed from the front, contrasting outer surface 20 of intermediate panel 14 is visible through openings 24.

The decorative openings may be in the form of a pleasing pattern, such as the array of diamond shaped openings 24 in FIG. 1. The openings may also be in the form of a logo such as the stylized CT design shown by the opening 24 in the bottom righthand corner of FIG. 1. Many other patterns, designs and/or logos may be provided.

Figure 3:
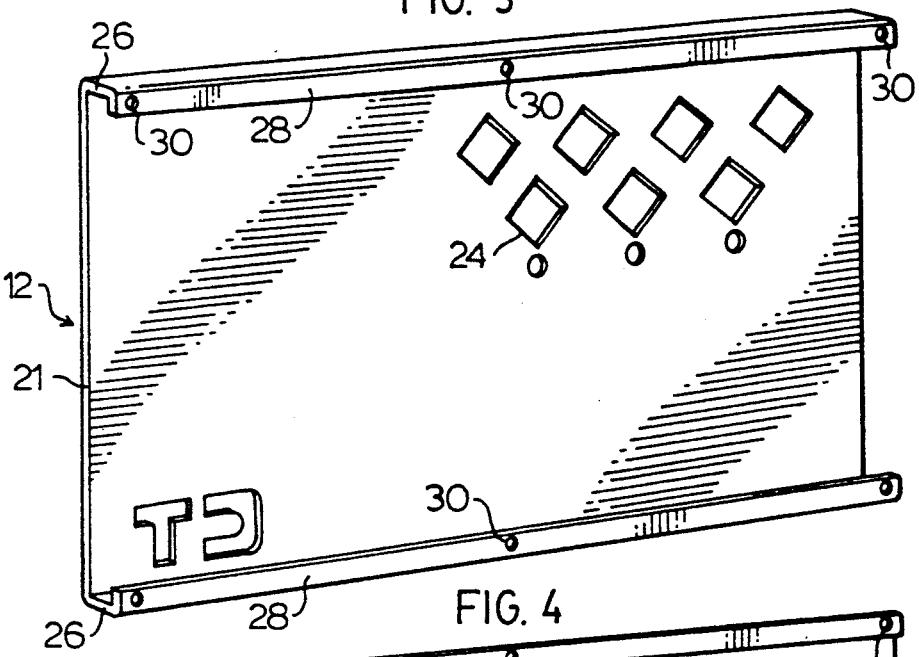
FIG. 3 is a perspective rear view of a front panel of the door of FIG. 1 ready for assembly.
Figure 4:
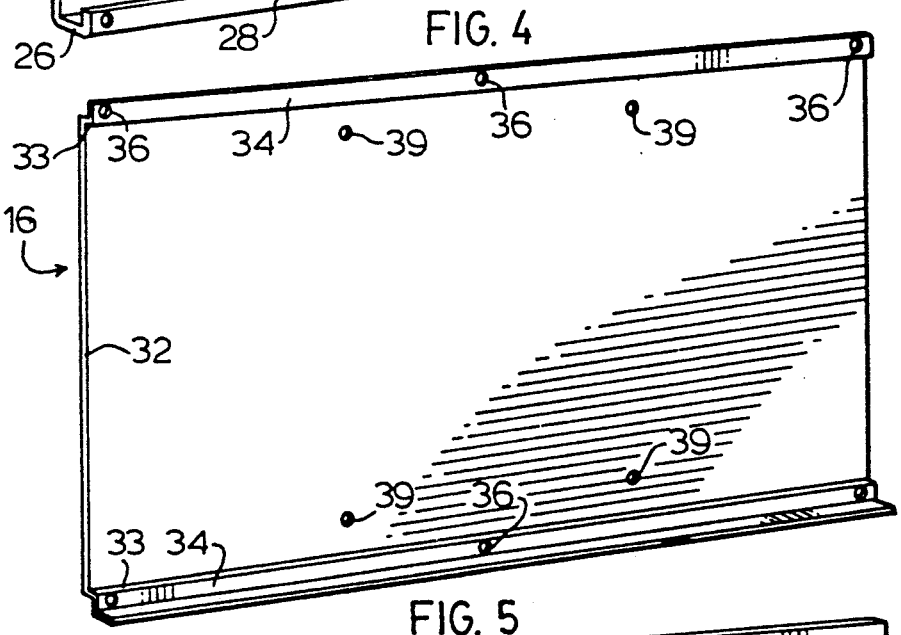
FIG. 4 is a perspective rear view of a rear panel of the door of FIG. 1 ready for assembly.
Figure 5:
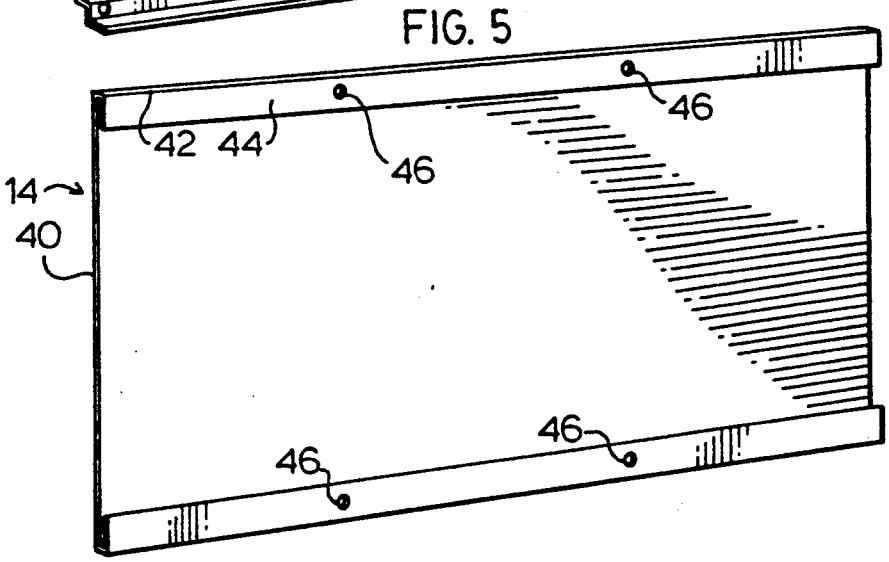
FIG. 5 is a perspective rear view of an intermediate panel of the door of FIG. 1 ready for assembly.

A preferred configuration for each of front panel 12, intermediate panel 14 and rear panel 16 is shown in FIGS. 3, 4 and 5, respectively.

As seen in FIG. 3, front panel 12 comprises a thin planar sheet of metal bent so as to provide at either end of a major flat central plane 21 an end surface 26 with an associated inturned flange 28. The decorative openings 24 are provided through major plane 21.

FIG. 4 shows rear panel 16 as a thin planar sheet of metal bent to provide at either end of a major flat central plane 32, step flanges comprising an end surface 33 and an out-turned flange 34. Holes 36 in flanges 34 align with holes 30 of front panel 12 and permit the front and rear panels to become coupled together by rivets 38 as shown in FIG. 2. Holes 39 in plane 32 are provided for coupling of the intermediate panel 14.

FIG. 5 similarly shows the intermediate panel 14 to be configured similar to the front panel 12 with a major plane 40 and, at each end, end surfaces 42 carrying inturned flanges 44. Holes 46 in flanges 44 align with holes 39 in rear panel 16 to permit the intermediate and rear panels to be coupled together by rivets 50 as shown in FIG. 2.

As is to be appreciated, the door 10 is assembled with decorative panel 14 intermediate front panel 12 and rear panel 16 such that major plane 40 of intermediate panel 14 is spaced rearwardly from the plane 21 of the front panel by a space 52 and the major plane 32 of the rear panel 16 is spaced rearwardly from the major plane 40 of the intermediate panel by a space 54. The outer surface 20 of intermediate panel 14 over its plane 40 is preferably of a contrasting colour and/or texture to the outer surface 22 of front panel 12 over its plane 21. This may conveniently be provided by painting the entirety of each of the outer surfaces of the front panel and the intermediate panel to be of different colours. The contrasting texture may be provided by having one of the other of the outer surfaces of the front panel or intermediate panel provided with a dimpled surface and/or covered by a coating such as a thin layer of textured vinyl laminate.

FIG. 1 shows in dotted line 56 the perimeter of the area of the outer surface 22 of the front panel 12 under which the outer surface 20 of the intermediate panel 14 lies. The area defined within this perimeter 56 is the area within which openings 24 can be cut from the front panel 12 and provide the desired pleasing appearance. As seen in FIG. 1, the intermediate panel 14 extends over substantially the entirety of the front panel 12.

The manufacture of each of the front panel 12, intermediate panel 14 and rear panel 16 may be preferably involve the following steps.

Figure 6:
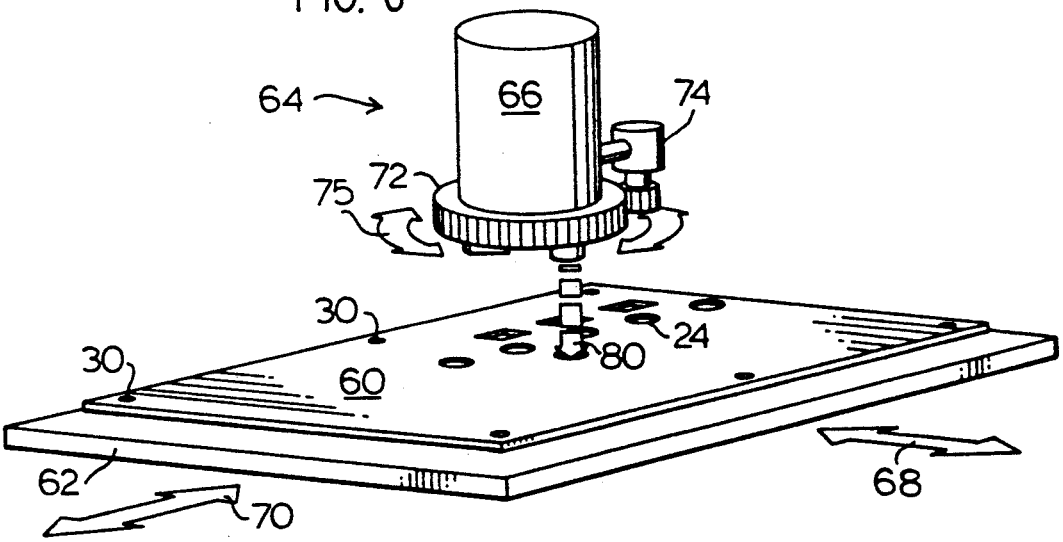
FIG. 6 is a schematic pictorial view of a punch press possessing a rotating die head.

Firstly, a panel is stamped or cut out of flat metal sheeting to provide a flat planar template such as 60 shown in FIG. 6. Next, apertures are punched from the flat template. These apertures to be punched include, firstly, apertures required to functionally couple and interconnect the panels together typified by holes 30, 36 and 46 and, secondly, apertures to form the decorative openings 24. It is to be appreciated by persons skilled in the art that the door 10 illustrated in FIG. 1 would have additional apertures punched therefrom so as to permit operative coupling of the door to a file cabinet. For simplicity, such other openings have not been shown.

In manufacture of the panels, after the holes are punched, the templates are then bent to form the respective end surfaces and flanges. Subsequently, the panels are primed and painted, preferably, by the priming and painting of all surfaces of the panels to provide corrosion resistance and convenience in automatic electrostatic painting. Finally, the panels are assembled into a final door 10 with any other necessary hardware for coupling to the file cabinet.

Figure 7:
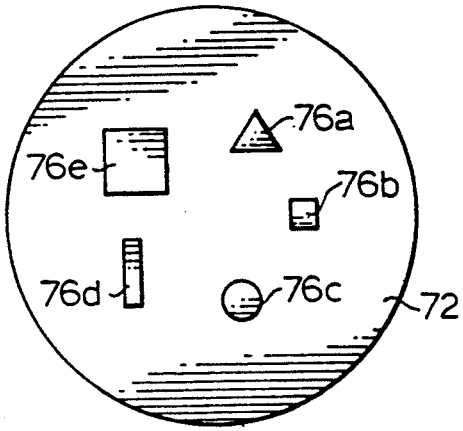
FIG. 7 is a schematic bottom view of the rotating die head of the punch press of FIG. 6 showing various dies.

FIGS. 6 and 7 schematically illustrate how all of the apertures in the template 60 for the front panel may be cut. As seen in FIG. 6, the template 60 is secured on a moveable work table-forming gig 62 over which there is mounted a computer controlled punch press generally indicated 64. The punch press has a die head 66 which is fixed above the gig. The gig is to be mounted on a support and positioning system so that the gig is moveable in its plane in the direction of arrows 68 and 70 so as to be capable of being automatically positioned at any location under the die head 66 by control and motor means not shown. The punch press has an automatically controlled and positioned rotating head 72 which may be rotated by motor 74 in the direction of arrow 75 and controlled by control means not shown. The head 72 carries a number of different sized and shaped dies illustrated as **76*a* to 76*f* in FIG. 7 which may be rotated so as to be in line with punch driving means (not shown) within the die head 66. The punch driving means can automatically be driven so as to punch the selected die downwardly as indicated by arrow 80 to punch apertures in the template 60**. Such computer controlled punch presses are known.

Control of the location of the punch press and the particular die used permits almost any configuration of openings to be cut from the template. For example, to create the stylized CT design shown in FIG. 1, a die similar to **76*e* may be used in sequence to nibble away metal by repeated punch strokes. As the punch press and its rotating die head are computer controlled, it requires almost no additional time to switch from punching one aperture configuration to another. Manufacture of front panels 12 without decorative openings 24 requires, in any event, the punching of functional holes such as 30 and there is no additional significant costs or time involved in also punching holes 24 when both the functional holes and the decorative openings are punched at the same time. The template 60** is retained in the gig by means not shown, such as electromagnets.

While the drawings show a preferred embodiment of the invention, it is to be appreciated that intermediate panel 14 is not necessary and a second embodiment would be substantially identical to that of FIG. 2 but with intermediate panel 14 removed and the rear panel 16 having its outer surface 80 of a contrasting colour to the outer surface 22 of the front panel. The intermediate panel 14 is advantageous so as to permit both the front panel and the rear panels to be electrostatically painted to be of the same colour and the intermediate panel 14 to be electrostatically painted a contrasting colour from the front and rear panels. Providing the intermediate panel 14 to extend over substantially the entirety of the rear of the front panel 12 permits intermediate panel 14 to be standardized for all cabinets subject to the constraints merely of locating the decorative openings 24 within the area defined by perimeter 56. Intermediate panel 14 is advantageous in providing increased strength in rigidity to the resultant door.

Having the intermediate panel 14 spaced rearwardly from the front panel 12 is advantageous so as to enhance the contrasting colour appearing although it is not necessary.

Although the disclosure describes and illustrates a preferred embodiment of the invention, it is to be understood that the invention is not limited to this particular embodiment. Many variations and modifications will now occur to those skilled in the art. For a definition of the invention, reference is made to the appended claims.

The embodiments of the invention in which an exclusive property or privilege is claimed are defined as follows:

1. A filing cabinet having a file cabinet door having:

a front panel formed of sheet metal extending over substantially the entirety of the front face of the door, a rear panel formed of sheet metal secured to the front panel rearward of the front panel and extending over substantially the entirety of the front panel, a decorative panel secured to the rear panel intermediate the front panel and rear panel, decorative openings through the front panel so that portions of the decorative panel are visible therethrough, said portions having contrasting visual appearance to the appearance of the front panel.

2. A filing cabinet as claimed in claim 1 wherein said decorative panel extends over substantially the entirety of the front panel.

3. A filing cabinet as claimed in claim 2 wherein said portions have said contrasting visual appearance by reason of the decorative panel having a different colour than that of the front panel.

4. A filing cabinet as claimed in claim 3 wherein said decorative openings form a pattern.

5. A filing cabinet as claimed in claim 4 wherein said decorative panel is spaced rearwardly from the front panel.

* * * * *